United States Patent [19]

Zwick

[11] Patent Number: 4,826,081

[45] Date of Patent: May 2, 1989

[54] UNIT TYPE FUEL INJECTOR FOR LOW LUBRICITY, LOW VISCOSITY FUELS

[76] Inventor: Eugene B. Zwick, 16841 Edgewater La., Huntington Beach, Calif. 92649

[21] Appl. No.: 88,416

[22] Filed: Aug. 20, 1987

[51] Int. Cl.[4] ..... F02M 47/02; F02M 61/10

[52] U.S. Cl. ..... 239/91; 239/88; 239/533.11

[58] Field of Search ..... 239/88–91, 239/533.3, 533.12

[56] References Cited

U.S. PATENT DOCUMENTS

| | | | |
|---|---|---|---|
| 3,566,849 | 3/1971 | Frick | 239/88 X |
| 4,567,872 | 2/1986 | Roosa | 239/88 X |
| 4,571,161 | 2/1986 | LeBlanc et al. | 239/88 X |

FOREIGN PATENT DOCUMENTS

| | | | |
|---|---|---|---|
| 2442010 | 3/1979 | Fed. Rep. of Germany | 239/88 |

*Primary Examiner*—Andres Kashnikow
*Assistant Examiner*—Patrick N. Burkhart
*Attorney, Agent, or Firm*—Beehler, Pavitt, Siegemund, Jagger, Martella & Dawes

[57] ABSTRACT

A unit fuel injector is modified for use with low lubricity, low viscosity fuels by the following: providing a replaceable, deformable fluid seal between the brushing and the injector body; providing a drain conduit extending through both the bushing and the injector body which connects a fluid collecting cavity in the bore of the bushing to an exterior drain outlet; providing a pair of non-galling materials respectively on the plunger and bushing; providing diametrically symmetrical fuel ports on the bushing; providing a diametrically symmetrical metering groove arrangement on the plunger; and increasing the spray tip orifices to provide approximately a 20% increase in fuel discharge rate.

2 Claims, 3 Drawing Sheets

UNIT TYPE FUEL INJECTOR FOR LOW LUBRICITY, LOW VISCOSITY FUELS

BACKGROUND OF THE INVENTION

Field of the Invention

The present invention pertains generally to the field of internal combustion engines and more particularly is directed to improvements in fuel injectors of the so-called unit type for improving the reliability and performance of such injectors when used with low lubricity, low viscosity fuels such as volatile aircraft fuels.

Background of the Invention

Diesel engines find widespread application in power plants requiring durability and reliability. Among other attractive attributes, is the rather wide range of fuel grades which can be efficiently burned by such engines. Although No. 2 commercial diesel fuel is most widely used for economical operation, diesel engines are capable of running on lighter fuels such as No. 1 diesel and jet fuels, as well as heavier grades of fuel including low sulfur crude oils. Lighter fuels than No. 2 diesel and in particular jet fuels, usually are costlier than diesel fuels and furthermore the lighter grade fuels have a lower BTU content and therefore yield less engine power output per unit of volume of fuel. Notwithstanding these shortcomings, however, in certain applications it is desirable to power diesel engines with the lighter grade fuels. This is the case, for example, with aircraft ground support equipment used in airports and especially by the Air Force. A wide array of ground equipment is used at air bases and aircraft maintenance facilities such as, for example, fuel pumps, pressurized gas pumps, liquid nitrogen vaporizers for providing gaseous nitrogen used, among other things, for inflating aircraft tires, aircraft towing vehicles and other diesel engine powered equipment.

Military logistics make it desirable to minimize the different grades of fuel required to run, for example, an air base and towards this objective, it becomes desirable to run the diesel powered aircraft support and other equipment on readily available jet fuel, particularly JP No. 4 fuel commonly used by jet aircraft. By eliminating the requirements for diesel fuels, considerable economies in requisitioning, handling and storing the diverse grades of fuel can be realized so as to not only compensate for the greater cost of the jet fuel but also improving the strategic position of the military unit.

While in theory a conventional diesel engine designed to run on No. 2 diesel fuel may be readily powered without modification by JP 4 fuel, it was found by this applicant that when a diesel engine was operated on JP 4 fuel, the engine was found to overheat and to also consume excessive amounts of oil. The specified engine when running on No. 2 diesel may be expected to burn approximately one gallon of oil per ten hours of engine operation. When run on JP 4 fuel it was discovered that instead the fluid level in the engine crankcase would rise substantially, rather than drop at the one gallon per ten hour expected rate due to normal oil consumption. The fluid level increase in the engine crankcase was eventually traced to fuel leakage from the fuel injectors into the engine crankcase at a rate in excess of the usual oil consumption rate, thereby producing a net fluid level rise in the crankcase. Futhermore, the engine oil became increasingly diluted by the jet fuel and its lubricating value steadily diminished until the main engine bearings failed for lack of lubrication.

The manufacturer of the diesel engine, the Detroit Diesel Company, was contacted for assistance in overcoming this problem by this this applicant. The manufacturer of the fuel injectors suggested, among other things, that a leakage problem existed because the caps which hold the spray tips to the injector body were not sufficiently tight, or in the alternative, that the O-ring provided as a seal between the injector body and this threaded cap was defective. This applicant tightened the injector caps, replaced the O-rings and found that the problem remained unsolved. The fuel injectors were type 9E95 manufactured by Rochester Products, a subsidiary of General Motors. Repeated requests for assistance were made by this applicant without either recognition by the injector manufacturer that a real leakage problem existed not practical assistance in solving the problems found when their engines were operated on JP 4 fuel.

Notwithstanding the foregoing difficulties, this applicant found a high level of interest on the part of the military in using jet fuel powered diesel engines and consequntly persisted in identifying the cause of the overheating, limited power output and fluid level rise in these engines.

SUMMARY OF THE INVENTION

The fuel injector is used in the aforementioned test engines were of the unit type i.e. fuel injectors having an injector body assembly including fuel supply and fuel return lines connected to a pump cavity in communication with an aperture spray tip. A plunger is reciprocable through the bore of a bushing held at an upper end against a circular lip of the injector body by means of a tubular cap threaded at one end onto a cylindrical extension of the injector body. The lower end of the threaded cap holds the spray tip assembly and fuel circulates through the interior of the cap but outside of the bushing at a typical pressure of 60 psi. First and second fuel port openings in the bushing allow fluid flow into the bushing bore and through a metering groove defined in the plunger supply a metered amount to a pump cavity defined at the lower end of the cap between the lower end of the plunger and the spray tip. The plunger is reciprocated by a cam drive and pressurizes the fuel admitted to the pump cavity to a typical pressure of 26,000 psi. This highly pressurized fuel is discharged as a finally atomized spray into an engine cylinder through small openings in the spray tip.

The unit fuel injector is modified by this applicant for use with low lubricity, low viscosity fuels such as JP-4 fuel by providing firstly, a deformable fluid seal between the bushing and the injector body such that the seal deforms under the torque applied between the injector cap and injector body when the two are screwed together. The bushing has a radial shoulder surface which abuts against an annular end surface of the injector body to make the necessary seal. The deformable seal element according to the present improvement is preferably fitted into a circular groove defined in one or both of the bushing shoulder surface or the injector body annular end surface such that the seal element is squeezed and deformed between these two surfaces. The seal element may be an O-ring of either copper forming a crush seal or a suitable elastomer where operating temperatures allow. It is particularly contemplated that the deformable bushing seal element be replaceable, in as much as these fuel injectors are frequently reconditioned after a period of usage and their useful life is thus extended. Much of the leakage problem experienced by this Applicant is believed traceable to the fact that whatever fluid seal is achieved between the bushing and the injector body at the factory, is never again duplicated once the unit has been disassembled for repair or reconditioning, yet reconditioned injectors are in wide spread usage and their continued fluid integrity is important. This source of continuing difficulty is overcome therefore by providing a replaceable, deformable seal element not found in current production injectors of the type described herein.

The factory injectors available from Detroit Diesel are sold with a gap between the plunger and bushing which is specified at a nominal 75 micro inches and may vary from less than 60 to as much as 90 micro inches for individual units. When operating on heavier diesel fuel, the fuel flowing between the plunger and bushing provides a measure of lubrication between these two parts and furthermore because of its greater viscosity does not seep and flow as readily between the two parts in an upward direction away from the spray pit, i.e. in a direction where it may eventually leak to the exterior or enter the crank case where it can mix with oil. A moderate or low level of such fuel leakage into the oil is readily tolerated in diesel fuel run engines. This applicant has found, however, that the lower viscosity of JP-4 fuel allows a substantially greater rate of fuel flow upwardly between the plunger and bushing than is experienced with diesel fuel. In addition, the low level lubricity of the jet fuel is conducive to greater wear, scoring and abrasion between the co-acting plunger and the bushing surfaces gradually increasing the gap between the two parts which in turn leads to greater fuel leakage rates.

According to the present invention this problem is minimized by providing a drain conduit extending through both the bushing and the injector body, connecting a fluid collecting cavity defined in the bore of said bushing to a drain outlet exterior to the injector body. Fuel seeping upwardly between the bushing and plunger thus collects within the collecting cavity and may be extracted by suction applied to the exterior drain outlet. Such suction is readily possible because of the pressure differential between the injector interior and external atmospheric pressure. For example, the exterior drain outlet may be in the form of a fitting adapted to couple with the end of a drain tube, the opposite end of the drain tube being connected, for example, to the intake of the engine fuel pump or to the engine fuel tank.

The problem of erosion and gap size increase between the plunger and bushing can be greatly alleviated by providing a non-galling pair of material, as for example, a hard chrome deposit on the plunger with a steel bushing surface. Current production unit injectors are sold with steel plungers acting within steel bushings, which through a galling effect lead to scoring of the bushing surface. These scores provide an enlarged leakage path for the low viscosity fuel which is readily able to escape through such openings.

The galling problem between the plunger and bushing is also aggravated by the nonsymmetrical configuration of the fuel ports in the bushing and the metering groove on the plunger which controls the volume of fuel admitted to the cavity under the plunger. This problem is alleviated according to this invention by providing diametrically symmetrical fuel ports on the bushing and also a diametrically symmetrical metering groove arrangement on the plunger to thus balance the side loads imposed on the plunger by fuel pressure.

Finally, it is considered desirable to increase the spray tip orifices of the injector to provide approximately a 20% increase in fuel discharge rate over the ratings of current production fuel injector units so as to compensate for the lower BTU content of JP-4 fuel in comparison with diesel No. 2 fuel.

It will be appreciated that a number of individual improvements and modifications to current production unit type fuel injectors are disclosed herein which may be implemented singly or in any combination to better adapt unit type fuel injectors for usage with low lubricity low viscosity fuels.

DETAILED DESCRIPTION OF THE PREFERRED EMBODIMENT

Figure 1:
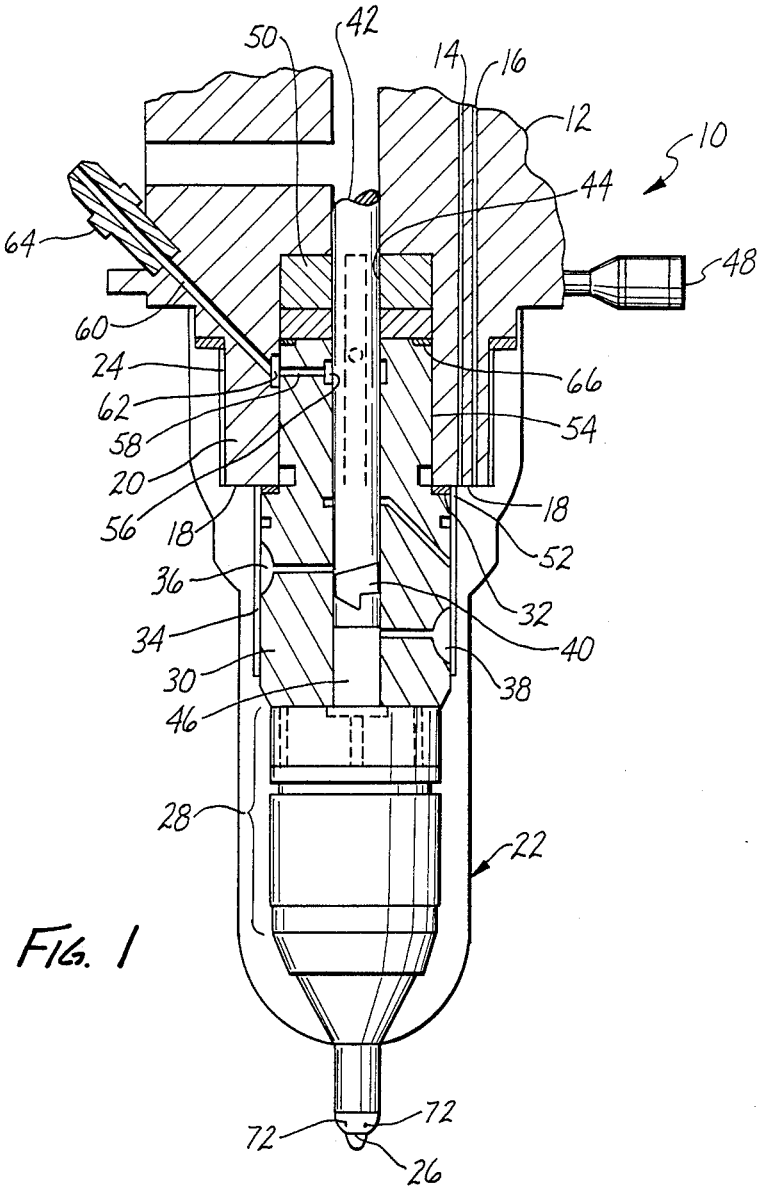
FIG. 1 is a elevational section of a unit type fuel injector modified according to the present invention.

With reference to the drawings, FIG. 1 shows a longitudinal section of a unit type fuel injector 10 which includes an injector body 12 shown in relevant part with its upper portion broken away.. Fuel inlet and outlet lines 14, 16 are defined in the injector body 12 and are connected through suitable fittings to fuel supply and drain conduits, not shown in the drawings. The lines 14, 16 terminate at an annular end surface 18 of a cylindrical tubular projection 20 integral with the injector body 12. A cap 22 is interiorly threaded and screws onto mating threads 24 defined on the outer cylindrical surface of the projection 20. At the lower end of the cap 22 is carried a spray tip 26 and a spray tip valve assembly 28 all of conventional design. An injector bushing 30 is contained partly within the cap 22 and partly within a cylindrical cavity defined in the injector body 12. The bushing 30 is cylindrical with an upper portion of reduced diameter defining an annular transition or shoulder 32 which is urged against the end surface 18 when the cap 22 is torqued on threads 24 during injector assembly. The inlet and outlet fuel lines 14, 16 both open into an annular cavity 34 which in normal injector operation s filled with fuel. The bushing 30 has an upper fuel port 36 and a lower fuel port 38 which respectively supply and drain fuel from a metering groove 40 defined on plunger 42. The plunger 42 is reciprocably driven within the internal bore of the bushing 30 by a cam/cam follower arrangement conventional in the art. When the plunger 42 is in its raised position within the bushing bore 44, a pump chamber 46 is defined between the lower end of the plunger 42 and the spray tip valve assembly 28 which is filled with a volume of fuel metered by rotation of the plunger 42. This metering rotation is achieved by a fuel rack 48 movable tangentially to the plunger 42. A plunger gear 50 converts linear rack motion to plunger rotation to position the helical metering groove 40 in relation to the fuel ports 36 38 so as to control the volume of fuel admitted to the pump chamber 46. Fuel control is achieved through a governor system connected to the rack 48 as known in the art. A first improvement to current production injector units is made by providing a deformable seal element 52 interposed between the annular bushing shoulder 32 and the annular end surface 18 of the injector body 12. In a present preferred embodiment, the deformable seal takes the form of a copper crush ring seal set into a groove cut into the annular end surface 18 of the bushing body radially inwardly of the end openings of fuel lines 14, 16. It is conventional to torque the cap 22 to a very high force onto the threaded projection 20 of the injector body. Using such conventional torquing, the newly provided deformable seal is crushed between the mating surfaces of the bushing and injector body such that the maliable copper material flows and confirms to any surface irregularities to provide Is positive fluid seal between the bushing and the injector body. The seal 52 thus prevents fuel flow from the cavity 36 upwardly into the gap 54 found between the upper portion of the bushing and the inside surface of the receiving cavity in the injector body 12. It has been found by this applicant that this gap 54 in production units is considerable and it is necessary to rely largely on effective fluid seal between the bushing shoulder and the end surface 18 to prevent fluid flow into the gap 54. Current production units, particularly rebuilt injector units do not provide satisfactory sealing in this area.

The injector 10 in FIG. 1 is further improved by providing an annular fluid collecting groove 56 within the bushing bore 44 near the upper end of the bushing. Any fuel seeping upwardly through the bore 44 between the bushing and the plunger 42 will tend to collect within the annular groove 56 and is drained from this groove through are radial drainage bore 58 which opens on the exterior surface of the bushing 30. A second drain conduit 60 is defined through the injector body 12 and connects an inner opening 62 to an external drain opening or fitting 64. In the production injector units the bushing 30 is circumferentially keyed to the injector body 12 so that the outer opening of the first drain 58 will be in fixed alignment and fluidic communication with the inner opening 62 of the second drain 60. The exterior drain fitting 64 may be connected through suitable tubing or conduits to a low pressure point, which may be merely atmospheric pressure in itself substantially below the pressure at the collecting groove 56, or may also be connected to the engine fuel tank of fuel pump inlet so as to establish a positive suction differential for drawing out fluids collecting in the groove 56. This groove is effective not only in collecting fuel leaking upwardly along the bore 44 but also collects crankcase oil flowing downwardly into the bushing bore 44.

In order to further safeguard against fuel leakage a drain seal 66 may be provided at the upper end of the bushing 30, either a crush seal or a suitable elastomeric seal to contain any fuel entering the gap 54 at the junction of the drain conduits 58, 60 at the inner coupling port 62.

Figure 2:
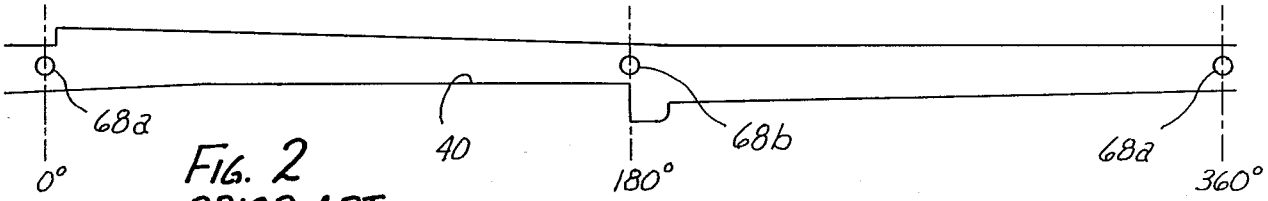
FIG. 2 PRIOR ART
FIG. 2 is a cylindrical development of the fuel metering helical groove in current production fuel injectors.
Figure 3:
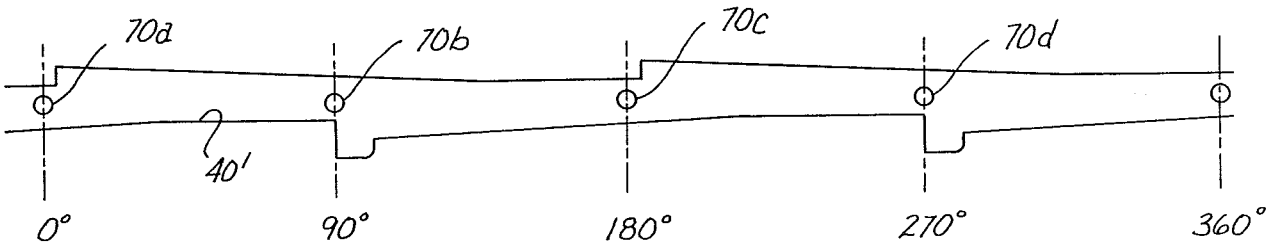
FIG. 3 is a development of the diametrically symmetrical metering groove arrangement according to the present invention.

FIG. 2 shows the helical metering groove provided on the plunger 42 in conventional injector units. The groove 40 includes two diametrically opposite fuel inlets 68A and 68B which open into an axial passage defined in the lower end of the plunger and terminating in an end port at the bottom of the plunger for discharging fuel into the pump cavity 46. During plunger downstroke the fuel in cavity 46 is highly pressurized and acts through the openings 68A and B, filling the asymmetrical groove 40 and imposing considerable side forces on the lower end of the plunger 42 against the inner surface of the bushing bore 44, causing scoring and wear of the same.

Figure 4:
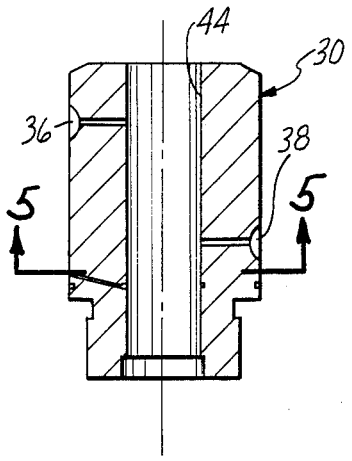
FIG. 4 PRIOR ART
FIG. 4 is a longitudinal section of a prior art injector bushing showing the asymmetrical fuel port arrangement.
Figure 5:
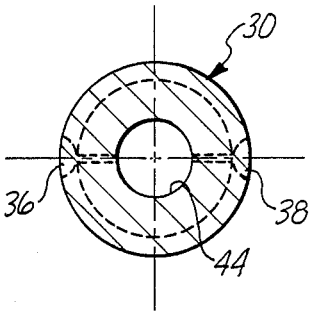
FIG. 5 PRIOR ART
FIG. 5 is a axial cross-section taken along the line 5—5 in FIG. 4.
Figure 6:
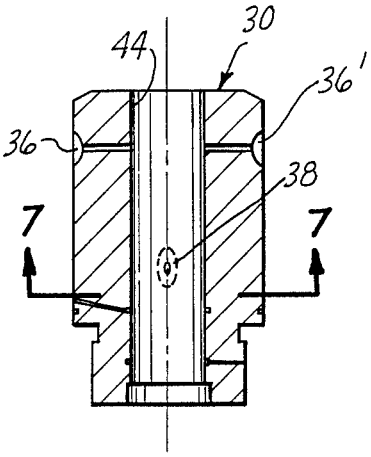
FIG. 6 is a longitudinal section of the injector bushing showing the diametrical symmetrical improved fuel port arrangement.
Figure 7:
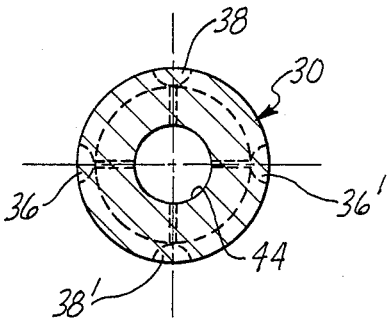
FIG. 7 is an axial section taken along the line 7—7 in FIG. 6.

This difficulty is overcome by providing a symmetrical fuel metering system, including a modified metering groove 40' having four radial ports 70A, 70B, 70C and 70D arranged circumferentially on the plunger 42 within the groove 40' at 90 degree intervals. All four bores 70A-D communicate with an axial conduit which opens to deliver fuel to cavity 46. The fuel metering system is further modified in that conventionally, the bushing 30 shown in FIGS. 4 and 5 is provided with only two fuel ports 36, 38 which cooperate with the metering groove 40 to provide a controlled volume of fuel to the cavity 46. Although these two ports are diametrically opposed on the bushing 30, as seen in FIG. 5, they are axially spaced as seen in FIG. 4 in order to properly cooperate with the helical metering groove 40 of the conventional injectors.

By making the metering groove 40' symmetrical according to this invention, the bushing 30 is modified by providing two fuel port pairs 36, 38 and 36', 38', each pair cooperating with a circumferential ½ of the diametrically symmetrical metering groove 40' so as to diametrically balance the side loads on the plunger 42 and consequntly minimize scoring and galling of the coacting bushing and plunger surfaces. The gain of the fuel rack governor system must be cut by ½ in order to accomodate the reduced circumference of each ½ of the symmetrically metering groove 40'.

As a fourth improvement in combating injector fuel leakage, the outer cylindrical surface of the plunger 42 is plated with a deposit of hard chrome. The chrome surface forms a nongalling pair with the steel surface of the bushing bore 44 and thus minimizes the scoring, wear and abrasion of these two coacting surfaces. It is also within the scope of this invention to use other materials forming nongalling pairs including various ceramics such as carbides, metal oxides and other materials known to those possessed of ordinary skill in this technology.

The spray tip 26 is conventionally provided with a number of very small discharge orifices 72 arranged as shown in FIG. 1. The dimension of the these discharge orifices 72 in part determine the volume of fuel delivered to the engine cylinder. In order to compensate for the lower energy content of the lighter jet fuel, it may be desirable to enlarge the discharge orifices 72 to allow for an approximately 20% increase rate of fuel delivery to the engine cylinder all other factors which determine fuel injection rate in a standard commercial product unit being held constant. It was found by this applicant that the output of a 500 HP diesel engine provided with 9E95 GM injectors dropped by 20% to a 400 HP output when the same engine was run on JP4 fuel. While a 10% drop in engine output is accounted for by the lower BTU content of the aircraft fuel, the other missing 10% could only be attributed to loss of fuel through injector leakage through the various paths addressed above by the present improvements. The diminished horsepower output let to slower cooling fan rotation, which in turn reduced the effectiveness of the engine cooling system leading to the aforementioned overheating problem. The reason for the engine overheating and crankcase fluid level rise was unknown until considerable research effort was expended by this applicant, and the nature and extend of the leakage problem when using light fuels was unknown to the manufacturer of the fuel injectors. This applicant has therefore both identified a problem which heretofore effectively prevented the use of aircraft fuels in diesel engines equipped with unit type fuel injectors, and in addition has here disclosed a number of improvements to the commercially available injector units for minimizing or eliminating the aforementioned leakage problem and thereby permit the use of jet aircraft fuels with such diesel engine fuel injectors.

While particular embodiments of the present invention have been shown and illustrated for purposes of clarity and example, it must be understood that may changes, modifications and substitutions to the described examples will become readily apparent to those possess of ordinary skill in th art without thereby departing from the scope and spirit of the present invention which is limited only by the claims.

What is claimed is:

1. In a unit fuel injector of the type having an injector body assembly defining fuel supply and return lines connected to a pump cavity communicating with an apertured spray tip, a plunger reciprocable through a bushing held in said body assembly for pressurizing fuel in said pump cavity, the fuel then discharging through said spray tip into an engine cylinder, first and second fuel port means in said bushing in fluidic communication with said pump cavity through metering groove means in said plunger, and fuel rack means for rotating said plunger thereby to regulate the fuel volume delivered to said pump cavity with each downstroke of said plunger, the improvement comprising:

deformable fluid seal means between said bushing and said body assembly, said seal means deforming under torque force applied between said bushing and said body to provide a positive seal against fuel leakage therebetween;

a fluid collecting cavity defined in the bore of said bushing, first drain means connecting said collecting cavity to an outer opening in the radially outer surface of said bushing, second drain means extending through said body including an inner opening in fluidic communication with said outer opening in the bushing and an external fitting for connecting said second rain means to a collecting vessel at substantially atmospheric pressure, thereby to positively draw out fuel seeping upwardly between said bushing and said plunger by the resulting pressure gradient in said first and second drain means;

said first and second fuel ports and said metering groove means being diameterically symmetrical about said plunger thereby to balance the side loads imposed on said plunger by fuel pressure differentials along said metering groove means and thus minimize internal scoring of said bushing.

2. The improvement of claim 1 wherein the coacting cylindrical surfaces of said bushing and said plunger are of non-galling materials thereby to minimize wear of said co-acting surfaces and enlargement of the gap therebetween.

* * * * *